US009109347B2

(12) United States Patent
Gotou et al.

(10) Patent No.: US 9,109,347 B2
(45) Date of Patent: Aug. 18, 2015

(54) REMOTE MANAGEMENT SYSTEM FOR WORK MACHINERY

(75) Inventors: Yuuki Gotou, Tsuchiura (JP); Kazuhiro Shibamori, Tsuchiura (JP); Hidenobu Tsukada, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 630 days.

(21) Appl. No.: 13/392,426

(22) PCT Filed: Aug. 26, 2010

(86) PCT No.: PCT/JP2010/064485

§ 371 (c)(1),
(2), (4) Date: Feb. 24, 2012

(87) PCT Pub. No.: WO2011/024897

PCT Pub. Date: Mar. 3, 2011

(65) Prior Publication Data

US 2012/0197465 A1 Aug. 2, 2012

(30) Foreign Application Priority Data

Aug. 27, 2009 (JP) ..... 2009-197197

(51) Int. Cl.

| | |
|---|---|
| ***G06F 17/00*** | (2006.01) |
| ***E02F 9/22*** | (2006.01) |
| ***E02F 9/20*** | (2006.01) |

(52) U.S. Cl.

CPC ..... *E02F 9/2246* (2013.01); *E02F 9/205* (2013.01); *E02F 9/2054* (2013.01)

(58) Field of Classification Search

CPC ..... E02F 9/205; E02F 9/2246; E02F 9/2054; B25J 9/0084; G05B 19/418; G05B 19/41815; G05B 19/4183; G05B 19/41865; G05B 19/4187

USPC ..... 701/2, 29.1, 29.3, 33.4, 50; 700/65, 83; 340/870.01, 870.02, 870.03, 870.07, 340/870.42

See application file for complete search history.

(56) References Cited

U.S. PATENT DOCUMENTS 6,427,107 B1 * 7/2002 Chiu et al. ..... 701/50
6,493,616 B1 * 12/2002 Rossow et al. ..... 701/50

(Continued)

FOREIGN PATENT DOCUMENTS

| | | |
|---|---|---|
| JP | 2005-83457 A | 3/2006 |
| JP | 2006-226255 A | 8/2006 |
| WO | WO 01/73218 A1 | 10/2001 |

OTHER PUBLICATIONS

International Search Report dated Dec. 7, 2010 including English-language translation (Two (2) pages).

*Primary Examiner* — Stephen Holwerda
(74) *Attorney, Agent, or Firm* — Crowell & Moring LLP

(57) ABSTRACT

A remote management system for at least one working machine manages an upper limit of an engine rpm. A hydraulic excavator includes a controller and an instruction switch for selectively instructing three kinds of work modes. The controller includes a target rpm storage unit, a target rpm computer for selecting one of stored upper limits of the target rpm according to an instruction by an instruction switch and computing a target rpm in a range smaller than the selected upper limit, and a communication unit. A server selects a work mode, according to an instruction by an input device, and instructs the selected work mode to the controller. When the work mode is instructed from the server, the target rpm computer computes a target rpm based on the instructed work mode.

10 Claims, 3 Drawing Sheets

(56) References Cited

U.S. PATENT DOCUMENTS

| | | | | |
|---|---|---|---|---|
| 2003/0144750 | A1 | 7/2003 | Watanabe et al. | |
| 2003/0193406 | A1* | 10/2003 | Kinugawa | 340/870.16 |
| 2003/0229432 | A1* | 12/2003 | Ho et al. | 701/50 |
| 2004/0034511 | A1* | 2/2004 | Shibamori et al. | 702/188 |
| 2004/0138790 | A1* | 7/2004 | Kapolka et al. | 701/29 |
| 2004/0162907 | A1* | 8/2004 | Kouda et al. | 709/229 |
| 2005/0131611 | A1* | 6/2005 | Anderson et al. | 701/50 |
| 2005/0278055 | A1* | 12/2005 | Ferguson et al. | 700/111 |
| 2006/0041350 | A1* | 2/2006 | Hoshaw | 701/36 |
| 2010/0023605 | A1* | 1/2010 | Li et al. | 709/221 |

* cited by examiner

REMOTE MANAGEMENT SYSTEM FOR WORK MACHINERY

TECHNICAL FIELD

This invention relates to a remote management system for at least one working machine, which remotely manages the working machine at a base station located away from the working machine.

BACKGROUND ART

A working machine such as a hydraulic excavator is provided with a hydraulic pump for feeding pressure oil to hydraulic actuators (hydraulic cylinders, hydraulic motor). This hydraulic pump is driven by an engine as a drive source. This engine is electronically controlled. An engine controller that performs the electronic control has a storage means, in which plural different upper limits of a target rpm for the engine as set beforehand and work modes set corresponding to the respective upper limits have been stored, and a control means for controlling the engine rpm by selecting one of the upper limits of the target rpm as stored in the storage means. In an operator's cab of the working machine, a switch is arranged as a work mode instruction means that is operated by an operator to instruct a work mode. According to the instruction from the switch, the engine controller selects the upper limit of the target rpm corresponding to the work mode. According to an engine output required for work which is about to be performed by the working machine, the upper limit of the target rpm for the engine is, therefore, selected from the plural upper limits, thereby making it possible to reduce a waste of an engine output and to economically use the working machine.

It is, however, cumbersome for the operator to change the work mode whenever the work details are changed. The operator, therefore, tends to leave the engine controller as instructed in the work mode in which an upper limit of the rpm higher than a required engine rpm is selected, whereby a problem has arisen in that the change of the upper limit of the target rpm is not made appropriately.

Accordingly, a means has already been contrived to limit the operator's selection of a work mode by a manager such as the owner of the working machine. This means has a control panel and a change management unit. The control panel is arranged together with the above-mentioned switch as the work mode instruction means in the operator's cab, and enables the input of a code number, while the change management unit sets the controller in one of two states, one being a state that allows to change the work mode upon input of the code number through the control panel, and the other a state that limits the changing of the work mode (see Patent Document 1).

Conventional remote management systems for working machines also include those which manage a control program and data of a control unit arranged on a hydraulic excavator by a server of a base station via communication lines. The remote management systems of this kind include those which, when the attachment of the front working mechanism of the hydraulic excavator has been changed, specifically when a bucket of a standard size has been changed to a wide bucket or a breaker or an arm of a standard size has been changed to a long arm, rewrite a control program and data, which are stored in the control unit and correspond to control of the front working mechanism having the bucket of the standard size, to contents corresponding to control of the front working mechanism having the broad bucket or breaker or rewrite a control program and data, which corresponds to control of the front working mechanism having the arm of the standard size, to contents corresponding to control of the front working mechanism having the long arm.

In such a remote management system, control units of hydraulic excavators each have a communication unit (hereinafter called "the machine-side communication unit"), and a base station has a server and a storage unit. Stored in the storage unit are the serial numbers of the hydraulic excavators, the models of the respective serial numbers, standard control programs and data for the respective models, control programs and data corresponding to various attachments of the respective models, and the like. To a communication unit (hereinafter called "the base station-side communication unit") arranged in the server, the control unit of each hydraulic excavator transmits information on an attachment change by the machine-side communication unit. By using the information stored in the storage unit, the server which has received the above-mentioned information identifies the serial number of the hydraulic excavator as an originator of the information on the attachment change, selects the control program and data corresponding to the new attachment of the identified hydraulic excavator, transmits these control program and data to the machine-side communication unit of the hydraulic excavator as the originator by the base station-side communication unit, and makes the control unit of the hydraulic excavator rewrite the previous control program and data (see Patent Document 2).

PRIOR ART DOCUMENTS

Patent Documents

Patent Document 1: WO-A-01/073218
Patent Document 2: JP-A-2006-226255

DISCLOSURE OF THE INVENTION

Problem to Be Solved by the Invention

In such a working machine as disclosed in Patent Document 1, input work is needed in an operator's cab of the working machine to limit the work mode. This input work is cumbersome when many working machines are involved or a working machine is located at a distant place. Like a remote management system for working machines such as that disclosed in Patent Document 2, it is hence desired to manage the work mode from a base station by communications.

An object of the present invention is to provide a remote management system for at least one working machine, which enables to remotely manage the upper limit of an engine rpm in preference to its upper limit set by an operator.

Means for Solving the Problem

To achieve the above-mentioned object, a remote management system according to the present invention for at least one working machine is constructed as will be described next.

[1] The remote management system according to the present invention for the working machine, said remote management system being provided with the working machine and a base station, is characterized in that the working machine comprises an engine as a drive source for a hydraulic pump that delivers pressure oil to be fed to plural hydraulic actuators, a control means for performing control of an rpm of the engine, and a machine-side work mode instruction means for selectively instructing plural kinds of work modes to the control means, the control means comprises a target rpm storage means in which upper limits of a target rpm for the engine as set corresponding to respective ones of the plural kinds of work modes have been stored, a target rpm computing means for selecting one of the upper limits of the target rpm, which have been stored in the target rpm storage means, according to the work mode instructed by the machine-side work mode instruction means and computing a target rpm not greater than the selected upper limit, and a machine-side communication unit, the base station comprises a work mode storage means in which the different kinds of the work modes of the working machine have been stored beforehand, a base station-side work mode instruction means for selecting a desired one of the work modes stored in the work mode storage means, a base station-side communication unit capable of communicating with the machine-side communication unit, and a work mode management means capable of instructing the work mode, which has been selected by the base station-side work mode instruction means, to the control means via the base station-side communication unit, and the target rpm computing means of the working machine is set such that, when the work mode is instructed to the control means by the work mode management means of the base station, a target rpm is computed based on the work mode instructed by the work mode management means.

In the remote management system as described above in [1], upon setting an upper limit of the target rpm on the side of the working machine, the machine-side work mode instruction means is used to select a desired work mode and to instruct it to the control means. The target rpm computing means of the control means then selects one of the upper limits of the target rpm, which have been stored in the target rpm storage means, according to the work mode instructed by the machine-side work mode instruction means, and computes a target rpm not greater than the selected upper limit. On the side of the base station, on the other hand, the base station-side work mode instruction means is used to select a desired work mode according to a request from a manager such as the owner of the working machine, so that one of the work modes stored in the work mode storage means is selected. The work mode management means then transmits the selected work mode by the base-side communication unit to the machine-side communication unit, whereby the work mode is instructed to the control means. As a result, the target rpm computing means is brought into a state that a target rpm is computed based on the work mode instructed by the work mode management means on the side of the base station. Therefore, the upper limit of the engine rpm can be remotely managed in preference to its upper limit set by an operator.

[2] The remote management system according to the present invention is characterized in that in the remote management system as described above in [1], the control means is set such that information on the work mode instructed by the machine-side work mode instruction means is transmitted by the machine-side communication unit to the base station-side communication unit, the base station further comprises a work mode appropriateness determination means for determining, based on the information on the work mode of the control means as received by the base station-side communication unit, whether or not the work mode instructed to the control means is appropriate, and the work mode appropriateness determination means determines whether or not the work mode of the control means is a work mode having a higher upper limit in target rpm than the work mode instructed by the base station-side work mode instruction means and, when the work mode of the control means is the work mode having the higher upper limit, determines that the work mode instructed to the control means by the machine-side work mode instruction means is inappropriate, and the work mode management means is set such that, when the work mode of the control means is determined to be inappropriate by the work mode appropriateness determination means, the work mode instructed by the base station-side work mode instruction means is instructed to the control means.

In the remote management system as described above in [2], when it is determined by the work mode appropriateness determination means that the work mode of the control means is a work mode having a higher upper limit in target rpm than the work mode instructed by the base station-side work mode instruction means, in other words, the work mode of the control means is inappropriate, the work mode management means instructs to the control means the work mode instructed by the base station-side work mode instruction means. As a consequence, the upper limit of the engine rpm can be lowered. The amount of fuel to be used per unit time by the engine can be decreased accordingly.

[3] The remote management system according to the present invention is characterized in that in the remote management system as described above in [2], the control means further comprises a used fuel amount computing means for computing an amount of fuel used by the engine per unit time, and is set such that the information on the work mode instructed by the machine-side work mode instruction means and information on the used amount of fuel as calculated by the used fuel amount computing means are transmitted by the machine-side communication unit to the base station-side communication unit, the base station further comprises a used fuel amount storage means in which lower limits of an amount of fuel to be used per unit time as set beforehand corresponding to respective ones of the plural kinds of work modes and a used fuel amount appropriateness determination means for determining whether or not the amount of the fuel used by the engine is appropriate, the used fuel amount appropriateness determination means determines whether or not the used amount of fuel as calculated by the used fuel amount computing means of the control means is smaller than the lower limit of used fuel amount corresponding to the work mode of the control means as stored in the used fuel amount storage means and, when the thus-calculated used fuel amount is smaller, determines the thus-calculated used fuel amount to be inappropriate, and the work mode management means is set such that, when the amount of fuel used by the engine is determined to be inappropriate by the used fuel amount appropriateness determination means and the work mode of the control means is determined to be inappropriate by the work mode appropriateness determination means, the work mode instructed by the base station-side work mode instruction means is instructed to the control means.

In the remote management system as described above in [3], when it is determined by the used fuel amount appropriateness determination means the used amount of fuel as calculated by the used fuel amount computing means is smaller than the lower limit of used fuel amount corresponding to the work mode of the control means as stored in the used fuel amount storage means, in other words, that the used fuel amount is inappropriate and it is determined by the work mode appropriateness determination means that the work mode instructed to the control means is a work mode having a higher upper limit in target rpm than the work mode instructed by the base station-side work mode instruction means, in other words, the work mode of the control means is inappropriate, the work mode management means instructs to the control means the work mode instructed by the base station-side work mode instruction means. As a consequence, the amount of fuel to be used per unit time can be surely decreased.

[4] The remote management system according to the present invention is characterized in that in the remote management system as described above in [2], the working machine further comprises a load pressure detection means for detecting a load pressure on the hydraulic pump and plural operational instruction detection means for detecting operational instructions to respective ones of the plural hydraulic actuators, the target rpm computing means is set such that, based on the load pressure detected by the load pressure detection means and the operational instructions detected by the plural operational instruction detection means, a target rpm not greater than the upper limit of the target rpm as set corresponding to the work mode is calculated, the control means is set such that the information on the work mode instructed by the machine-side work mode instruction means, the information on the load pressure and the information on the operational instructions are transmitted by the machine-side communication unit to the base station-side communication unit, the base station further comprises a work load storage means in which lower limits of a work load as set beforehand corresponding to respective ones of the plural kinds of work modes have been stored, a work load computing means for computing a work load based on the information on the work load and the operational instruction from the control means, and a work load appropriateness determination means for determining whether or not the work load calculated by the work load computing means is appropriate, and the work load appropriateness determination means determines whether or not the work load calculated by the work load computing means is smaller than the lower limit of work load as stored in the work load storage means and corresponding to the work mode of the control means and, when the calculated work load is smaller, determines the calculated work load to be inappropriate, and the work mode management means is set such that, when the work load is determined to be inappropriate by the work load appropriateness determination means and the work mode of the control means is determined to be inappropriate by the work load appropriateness determination means, the work mode instructed by the base station-side work mode instruction means is instructed to the control means.

In the remote management system as described above in [4], when it is determined by the work load appropriateness determination means that the work load calculated by the work load computing means is smaller than the lower limit of work load as stored in the work load storage means and corresponding to the work mode of the control means, in other words, the calculated work load is inappropriate, and further, it is determined by the work mode appropriateness determination means that the work mode instructed to the control means is a work mode having a higher upper limit in target rpm than the work mode instructed by the base station-side work mode instruction means, in other words, the work mode of the control means is inappropriate, the work mode instructed by the base station-side work mode instruction means is instructed to the control means. As a consequence, if an excessively large work load would be applied to the working machine in a work mode which lowers the upper limit of the target rpm and is about to be instructed to the control means from the base station, this work mode is not instructed, thereby enabling to prevent the occurrence of a situation that the work efficiency of the working machine would be reduced.

[5] The remote management system according to the present invention is characterized in that in the remote management system as described above in [2], the working machine further comprises a load pressure detection means for detecting a load pressure on the hydraulic pump and plural operational instruction detection means for detecting operational instructions to respective ones of the plural hydraulic actuators, the target rpm computing means is set such that, based on the load pressure detected by the load pressure detection means and the operational instructions detected by the plural operational instruction detection means, a target rpm not greater than the upper limit of the target rpm as set corresponding to the work mode is calculated, the control means comprises a used fuel amount computing means for computing an amount of fuel used by the engine per unit time, the control means is set such that the information on the work mode instructed by the machine-side work mode instruction means, the information on the load pressure, the information on the operational instructions and the information on the used amount of fuel as calculated by the used fuel amount computing means are transmitted by the machine-side communication unit to the base station-side communication unit, the base station further comprises a used fuel amount storage means in which lower limits of an amount of fuel used per unit time as set beforehand corresponding to respective ones of the plural kinds of work modes have been stored, a used fuel amount appropriateness determination means for determining whether or not the amount of fuel used by the engine is appropriate, a work load storage means in which lower limits of a work load as set beforehand corresponding to respective ones of the plural kinds of work modes have been stored beforehand, a work load computing means for computing a work load based on the information on the work load and the operational instructions from the control means, and a work load appropriateness determination means for determining whether or not the work load calculated by the work load computing means is appropriate, the used fuel amount appropriateness determination means determines whether or not the used amount of fuel as calculated by the used fuel amount computing means of the control means is smaller than the lower limit of the used fuel amount as stored in the used fuel amount storage means and corresponding to the work mode of the control means and, when the thus-calculated used amount of fuel is smaller, determines the thus-calculated used amount of fuel to be inappropriate, the work load appropriateness determination means determines whether or not the work load calculated by the work load computing means is smaller than the lower limit of work load as stored in the work load storage means and corresponding to the work mode of the control means and, when the calculated work load is smaller, determines the calculated work load to be inappropriate, and the work mode management means is set such that, when the amount of fuel used by the engine is determined to be inappropriate by the used fuel amount appropriateness determination means, the work load is determined to be inappropriate by the work load appropriateness determination means and the work mode of the control means is determined to be inappropriate by the work load appropriateness determination means, the work mode instructed by the base station-side work mode instruction means is instructed to the control means.

In the remote management system as described above in [5], when it is determined by the used fuel amount appropriateness determination means that the used amount of fuel as calculated by the used fuel amount computing means is smaller than the lower limit of the used amount of fuel as stored in the used fuel amount storage means and corresponding to the work mode of the control means, in other words, the used amount of fuel so calculated is inappropriate, it is determined by the work load appropriateness determination means that the work load calculated by the work load computing means is smaller than the lower limit of work load as stored in the work load storage means and corresponding to the work mode of the control means, in other words, the calculated work load is inappropriate, and further, it is determined by the work mode appropriateness determination means that the work mode of the control means is a work mode having a higher upper limit in target rpm than the work mode instructed by the base station-side work mode instruction means, in other words, the work mode of the control means is in appropriate, the work mode instructed by the base station-side work mode instruction means is instructed to the control means. As a consequence, it is possible to surely decrease the amount of fuel to be used per unit time, and also to prevent the occurrence of a situation that the work efficiency would be reduced.

[6] The remote management system according to the present invention is characterized in that in the remote management system as described above in any one of [1] to [5], the base station further comprises a registration information storage means in which registration information on plural working machines have been stored beforehand, and a search means for searching for a specific one of the working machines by using the registration information stored in the registration information storage means, and the work mode management means is set such that the work mode is instructed to only the working machine searched out by the search means.

In the remote management system as described above in [6], the work mode management means instructs the work mode to only the working machine searched out by the search means.

[7] The remote management system according to the present invention is characterized in that in the remote management system as described above in [1], the timing at which the control means moves to the work mode instructed by the work mode management means of the base station is set to fall during a rest of the working machine.

The remote management system as described above in [7] can prevent the engine rpm from suddenly dropping during work by the working machine. The upper limit of the engine rpm can, therefore, be lowered safely.

[8] The remote management system according to the present invention is characterized in that in the remote management system as described above in [7], the control means further comprises an instructed mode storage means for storing the work mode, which has been instructed from the work mode management means of the base station, upon shut-down of the control means, and is set such that at a timing of a start-up of the control means, the control means moves to the work mode stored in the instructed mode storage means.

In the remote management system as described above in [8], the target rpm computing means moves to a state that at a timing of a start-up of the control means, a target rpm is computed based on the work mode stored in the instructed mode storage means. As the time of the start-up of the control means is before a start-up of the engine or shortly after the start-up of the engine, the working machine is at rest. It is, therefore, possible to make the control means move to the work mode stored in the instructed mode storage means during a rest of the working machine.

[9] The remote management system according to the present invention is characterized in that in the remote management system as described above in [7], the working machine further comprises hydraulic pilot control valves arranged corresponding to respective ones of the plural hydraulic actuators to control directions and flow rates of flows of pressure oil to be fed to the corresponding hydraulic actuators, a gate lock valve capable of cutting off feeding of a pilot pressure to the hydraulic pilot control valves, and a gate lock detection means for detecting whether a valve position of the gate lock valve is a closed position where the pilot pressure is cut off or an open position where the pilot pressure is communicated, and the control means further comprises an instructed mode storage means for storing the work mode instructed from the work mode management means of the base station when the gate lock detection means senses a change in the valve position from the open position to the closed position, and is set such that, at a timing at which the gate lock detection means has detected a change in the valve position from the closed position to the open position, the control means moves to the work mode stored in the instructed mode storage means.

In the remote management system as described above in [9], the target speed computing means moves, at the timing at which the gate lock detection means has detected a change in the valve position from the closed position to the open position, to a state that a target rpm is computed based on the work mode stored in the instructed mode storage mean. The timing at which the gate lock detection means has detected the change in the valve position from the closed position to the open position is shortly after that the feeding of a pilot pressure to the hydraulic pilot control valve has become feasible. At this time, the valve position of the hydraulic pilot control valve is not a valve position at which oil delivered from the hydraulic pump is guided to the corresponding hydraulic actuator, and therefore, the working machine is at rest. During a rest of the working machine, the control means can, therefore, be moved to the work mode stored in the instructed mode storage means.

Advantageous Effects of the Invention

According to the present invention, the work mode that sets the upper limit of the engine rpm can be set not only on the side of the working machine but also from the side of the base station, and moreover, the setting from the side of the base station is set to have priority depending on conditions. The rpm of the engine can, therefore, be managed to conform to an appropriate work mode even when the working machine is located away from the base station or there are many working machines to be managed.

MODES FOR CARRYING OUT THE INVENTION

Figure 1:
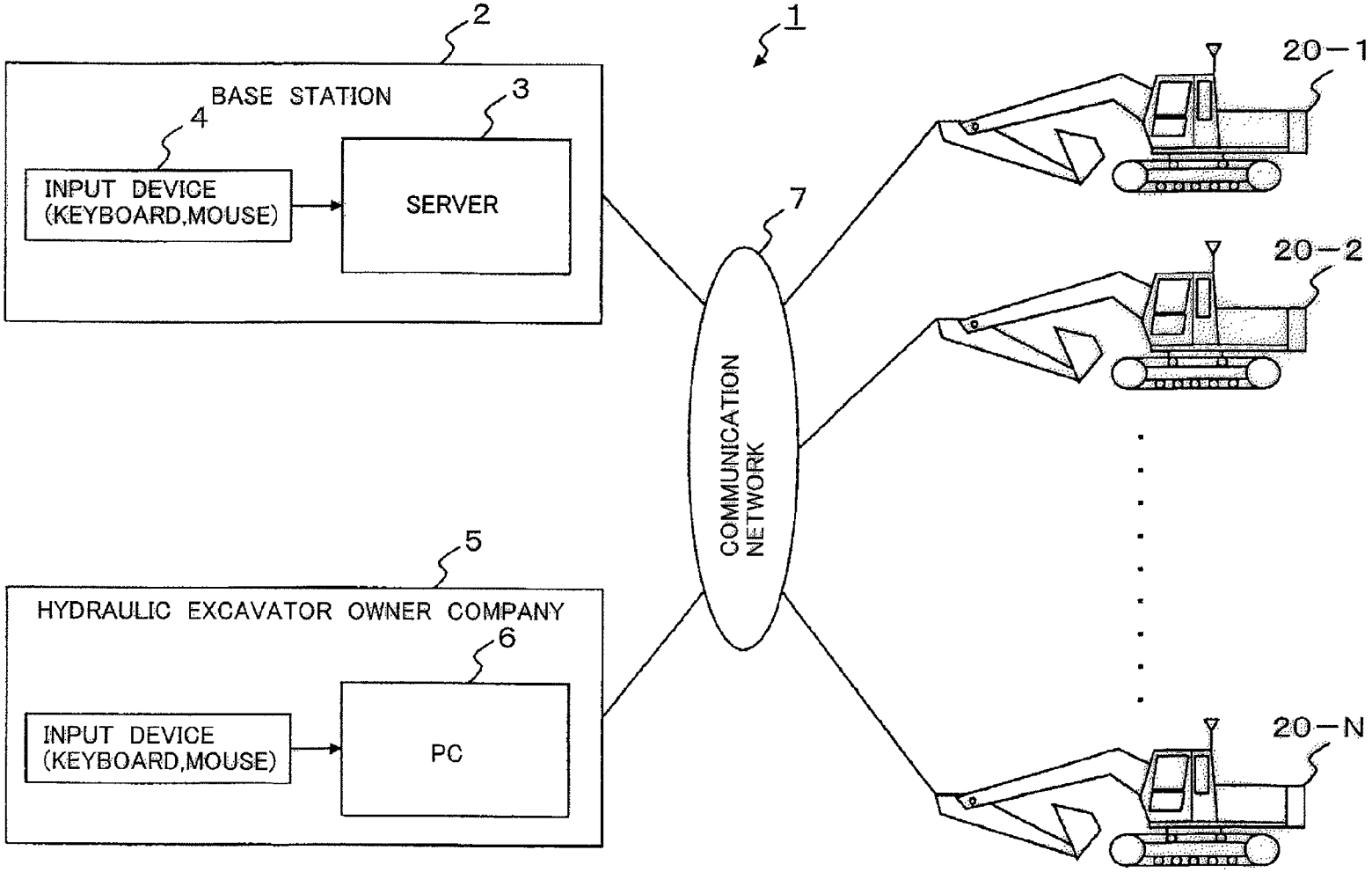
FIG. 1 is a block diagram illustrating the overall configuration of a remote management system according to one embodiment of the present invention.
Figure 2:
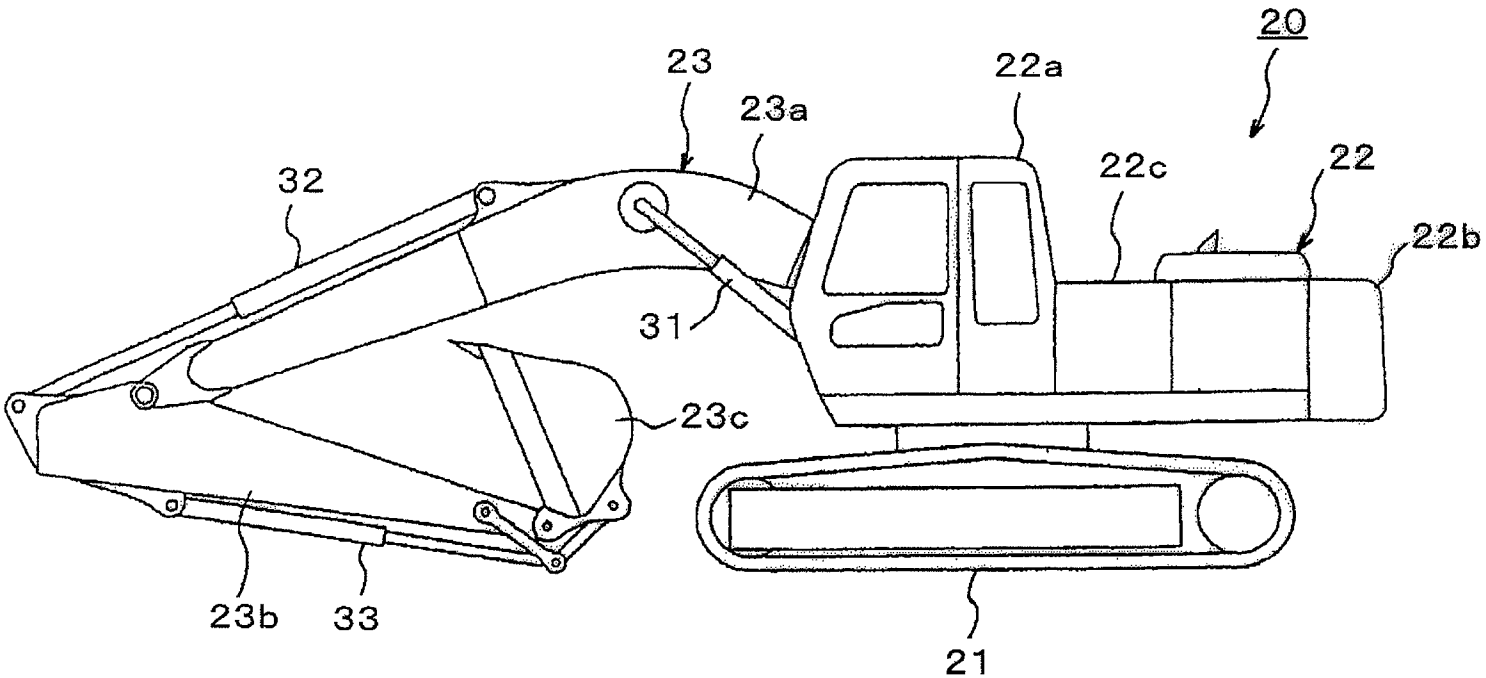
FIG. 2 is a left side view of a hydraulic excavator as a working machine to be remotely managed by the remote management system illustrated in FIG. 1.
Figure 3:
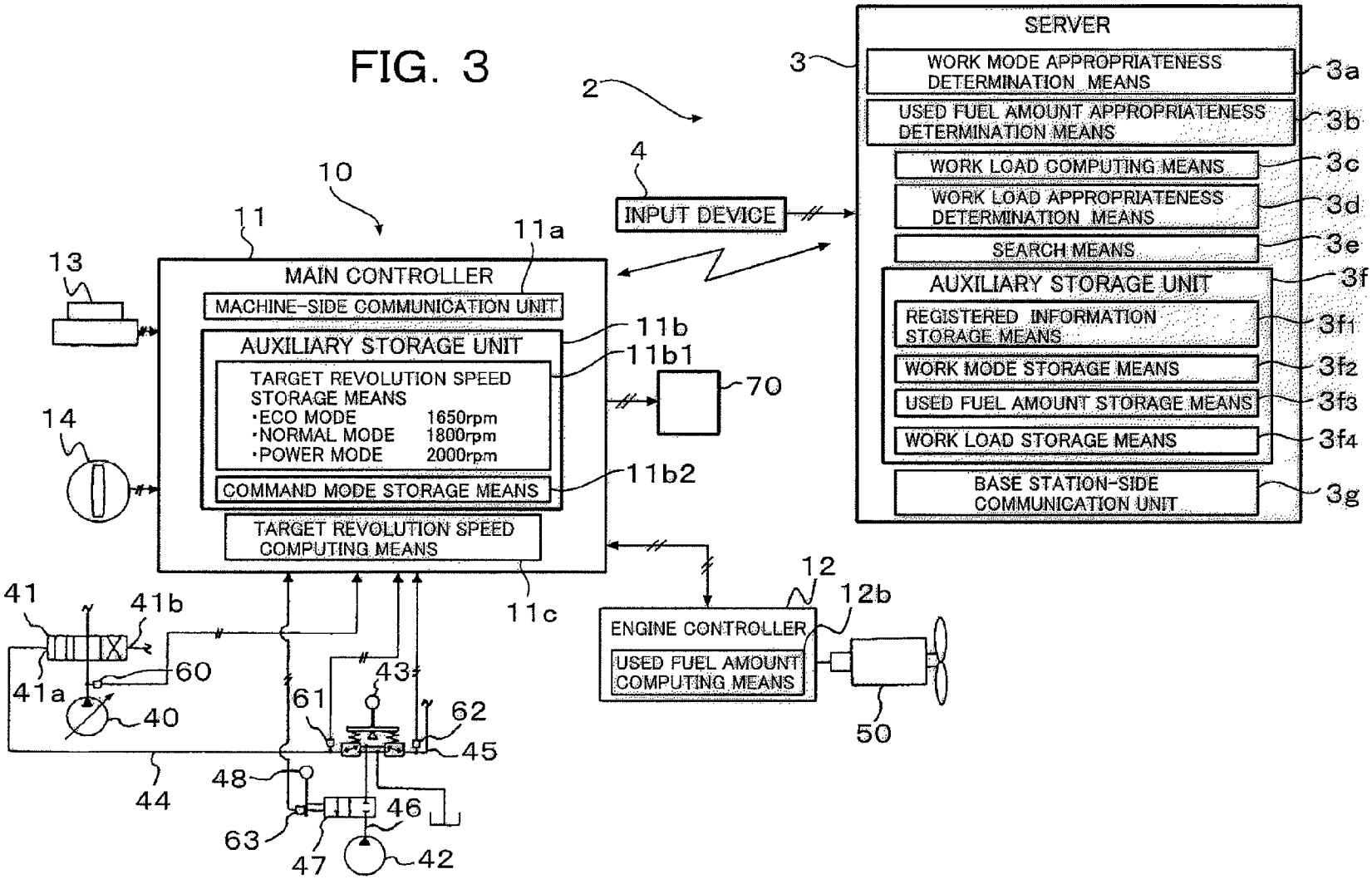
FIG. 3 is a block diagram depicting the configuration of a control means arranged on the hydraulic excavator shown in FIG. 2 and configuration details of a base station.

With reference to FIG. 1 through FIG. 3, a description will be made about one embodiment of the present invention.

As illustrated in FIG. 1, a remote management system 1 according to this embodiment for working machines has a base station 2. This base station 2 is provided with a server 3. Via a communication network 7, this server 3 can be connected to hydraulic excavators 20-1 to 20-N as the working machines and also to a personal computer (PC) 6 at a company 5 which owns these hydraulic excavators 20-1 to 20-N (a construction machinery rental company or lease company, a construction company or the like).

As shown in FIG. 2, the hydraulic excavators 20-1 to 20-N each have a travel base 21 capable of traveling by driving crawler tracks, a revolving upper structure 22 swingably connected to the travel base 21, and a front working mechanism 23 substantially centrally arranged on a front section of the revolving upperstructure 22. The revolving upperstructure 22 has an operator's cab 22*a* arranged on the left of the front working mechanism 23, a counterweight 22*b* forming a rear end section of the revolving upperstructure 22, and an engine compartment 22*c* formed over between a rear of the operator's cab 22*a* and the counterweight 22*b*. The front working mechanism 23 is of the backhoe type, and has a boom 23*a* connected pivotally in an up-and-down direction to the front section of the revolving upperstructure 22, an arm 23*b* pivotally connected to the boom 23*a*, and a bucket 23*c* pivotally connected to the arm 23*b*.

The hydraulic excavators 20-1 to 20-N are each provided with plural hydraulic actuators for driving the travel base 21, revolving upperstructure 22 and front working mechanism 23, respectively. These plural actuators specifically include a left travel motor (not shown) and right travel motor (not shown) for driving the left and right crawler tracks of the travel base 21, respectively, a swing motor (not shown) for driving the revolving upperstructure 22, a boom cylinder 31 for driving the boom 23*a*, an arm cylinder 32 for driving the arm 23*b*, and a bucket cylinder 33 for driving the bucket 23*c*. To these hydraulic actuators, delivery oil of a main pump 40 (variable displacement hydraulic pump) depicted in FIG. 3 is fed. This main pump 40 is driven by an engine 50.

Between the main pump 40 and the left travel motor, between the main pump 40 and the right travel motor, between the main pump 40 and the swing motor, between the main pump 40 and the boom cylinder 23*a*, between the main pump 40 and the arm cylinder 23*b*, and between the main pump 40 and the bucket cylinder 23*c*, hydraulic pilot control valves are arranged, respectively, to control the operation of these hydraulic actuators. These control valves control the directions and flow rates of flows of pressure oil to be fed to the respective hydraulic actuators such as the left travel motor, right travel motor, swing motor, boom cylinder 23*a*, arm cylinder 23*b* and bucket cylinder 23. In FIG. 3, one of these control valves is depicted as a control valve 41 for the sake of simplification of the figure.

The engine 50 also drives a pilot pump 42 (fixed displacement hydraulic pump) in addition to the main pump 40. Although not depicted in the figure, plural control lever devices for producing operating pressures (pilot pressures) for the above-mentioned, respective plural control valves from pressure oil delivered from the pilot pump 42, specifically a left travel control lever device, right travel control lever device, swing/arm control lever device and boom/bucket control lever device are arranged in the operator's cab 22*a*.

Among these control lever devices, the control lever device that controls the control valve 41 is depicted as a control lever device 43 in FIG. 3 for the sake of simplification of the figure. In pilot lines 44,45 for guiding a pilot pressure from this control lever device 43 to hydraulic pilot ports 41*a*,41*b* of the control valve 41, pilot pressure sensors 61, 62 (pressure sensors) are arranged as an operation instruction detection means for detecting the pilot pressure as an operational instruct ion for the corresponding hydraulic actuator and outputting a pilot pressure signal (electrical signal) corresponding to the pilot pressure. Each hydraulic pilot port is provided with one pilot pressure sensor.

Ina line 46 that guides pressure oil from the pilot pump 42 to the control lever device 43, there are arranged a gate lock valve 47 capable of collectively cutting off feeding of a pilot pressure to the control valve 41 and a gate lock switch 63 (for example, limit switch) as a gate lock detection means for detecting whether a valve position of the gate lock valve 47 is a closed position where the pilot pressure is cut off or an open position where the pilot pressure is communicated. The gate lock switch 63 is turned off in the closed position, but is turned on in the open position to output an ON signal (electrical signal). The valve position of the gate lock valve 47 is selectively switched to either the closed position or the open position in conjunction with the position of a gate lock lever 48 arranged in the operator's cab 22*a*.

The main pump 40 is provided with a load pressure sensor 60 (pressure sensor), which senses a load pressure on the main pump 40 and outputs a load pressure signal (electrical signal) corresponding to the load pressure.

An EC dial selector 14 is arranged in the operator's cab 22*a*. This EC dial selector 14 outputs an angle of rotation of the dial by converting it to an rpm instruction signal (electrical signal) corresponding to a value in an engine rpm range which has been set beforehand. An upper limit of the target rpm, which can be instructed by this EC dial selector 14, may be 1,800 rpm, for example.

In the operator's cab 22*a*, an instruction switch 13 is also arranged as a machine-side work mode instruction means for selectively instructing, for example, three kinds of work modes (economy mode, normal mode, power mode). This instruction switch 13 is a self-returnable push switch and, when pushed and turned on, outputs a work mode instruction signal (electrical signal).

The pilot pressure signals outputted from the pilot pressure sensors 61,62, the ON signal outputted from the gate lock switch 63, the load pressure signal outputted from the load pressure sensor 60, the rpm instruction signal outputted from the EC dial selector 14 and the work mode instruction signal outputted from the instruction switch 13 are all inputted to a main controller 11.

The main controller 11 is arranged on each of the hydraulic excavators 20-1 to 20-N. The main control 11 is provided with a CPU (central processing unit), a ROM (read only memory) in which a program and data have been stored, a RAM (random access memory) useful as a work area for the CPU, an auxiliary storage unit 11*b* in which the program and data have been stored in addition to their storage in the ROM, and the like, and the CPU reads out the program and data stored in the ROM or auxiliary storage unit 11*b* to perform computation of a target rpm for the engine 50 and processing relating to the instruction.

Attached to the engine 50 is an engine controller 12 that performs electronic control of the engine rpm. The main controller 11 calculates a target rpm, and delivers it to the engine controller 12. The engine controller 12 is provided with a CPU, a ROM in which a program and data have been stored, a RAM useful as a work area for the CPU, an auxiliary storage unit in which the program and data have been stored in addition to their storage in the ROM, and the like, and the CPU reads out the program and data stored in the ROM or auxiliary storage unit to perform processing for the control of the rpm of the engine 50 according to the target rpm instructed from the main controller 11.

The main controller 11 and engine controller 12 make up a control means 10 for controlling the rpm of the engine 50.

A descript ion will next be made about configuration details of the base station 2 and control means 10.

The main controller 11 has a target rpm storage means 11*b*1 in which upper limits of the target rpm for the engine 50 as set corresponding to the above-mentioned three kinds of work modes, that is, the eco mode, normal mode and power mode have been stored beforehand. This target rpm storage means 11*b*1 is arranged by using the auxiliary storage unit 11*b*. The upper limit of the target rpm as set corresponding to the eco mode is, for example, 1,650 rpm set to enable light-load work such as ground leveling. The upper limit of the target rpm as set corresponding to the normal mode is an rpm higher than that for the eco mode, for example, 1,800 rpm set to enable normal digging work which is performed in dump truck loading or the like. The upper limit of the target rpm as set corresponding to the power mode is an rpm higher than that for the normal mode, for example, 2,000 rpm set to enable heavy-load work such as root raking or deep digging.

The main controller 11 also has a target rpm computing means 11*c* for computing a target rpm. This target rpm computing means 11*c* is set such that one of the upper limits of the target rpm, which have been stored in the target rpm storage means 11*b*1, is selected according to the work mode instructed by the instruction switch 13 (machine-side work mode instruction means), and corresponding to the work mode, a target rpm is calculated within a range not greater than the selected upper limit based on the load pressure sensed by the load pressure sensor 60 (load pressure sensing means) and the pilot pressure (operational instruction) sensed by the pilot pressure sensor 61 or 62 (operational instruction detection means).

It is to be noted that the target rpm computing means 11*c* performs the computation of the target rpm irrespective of the target rpm instructed by the EC dial selector 14 while using, as the upper limit of the target rpm, the upper limit of the target rpm as set corresponding to the work mode. Described specifically, when the main controller 11 is set in the eco mode to which 1,650 rpm has been set to correspond as the upper limit of the target rpm, the upper limit of the target rpm to be calculated by the target rpm computing means 11*c* will be 1,650 rpm even if the EC dial selector 14 has instructed 1,800 rpm as a target rpm. When the main controller 11 is set in the power mode to which 2,000 rpm has been set to correspond as the upper limit of the target rpm, on the other hand, the upper limit of the target rpm to be calculated by the target rpm computing means 11*c* will be 2,000 rpm even if the EC dial selector 14 has instructed 1,800 rpm as a target rpm.

The main controller 11 is basically set in the normal mode upon start-up. When a work mode instruction signal is inputted from the instruction switch 13 to the main controller 11 in this state, the main controller 11 moves to the power mode. When another work mode instruction signal is inputted from the instruction switch 13 to the main controller 11, the main controller 11 moves to the eco mode. When a further work mode instruction signal is inputted from the instruction switch 13 to the main controller 11, the main controller 11 returns to the normal mode. The work mode that specifies the upper limit of the target rpm is, therefore, set to be switched in the order of the normal mode→the power mode→the eco mode→ . . . upon every input of a work mode instruction signal from the instruction switch 13 to the main controller 11. It is, however, to be noted that in a particular situation, the main controller 11 is not set in the normal mode upon start-up. This situation will be described subsequently herein.

The main controller 11 also has a machine-side communication unit 11*a*, which can communicate with external communication units via the communication network 7. This machine-side communication unit 11*a* performs wireless communications.

The server 3 of the base station 2 is provided with a CPU, a ROM in which a program and data have been stored, a RAM useful as a work area for the CPU, an auxiliary storage unit in which the program and data have been stored in addition to their storage in the ROM, and the like, and the CPU reads out the program and data stored in the ROM or auxiliary storage unit 3*f* to perform processing for the management of the work mode of the main controller 11 of each of the hydraulic excavators 20-1 to 20-N.

The server 3 also has a registration information storage means 3*f*1 in which registration information of the respective hydraulic excavators 20-1 to 20-N, specifically, their serial numbers (No. 1 to No. N) and models have been stored beforehand, a work mode storage means 3*f*2 in which the three kinds of work mode (eco mode, normal mode, power mode) and the upper limits of the target rpm as set corresponding to the respective modes have been stored beforehand, a used fuel amount storage means 3*f*3 in which the lower limits of the amount of fuel to be used per unit time as set beforehand corresponding to the respective ones of the three kinds of work modes have been stored, and a work load storage means 3*f*4 in which the lower limits of the work load as set beforehand corresponding to the respective ones of the three kinds of work modes have been stored. These storage means 3*f*1 to 3*f*4 are all arranged by using the auxiliary storage unit 3*f*. It is to be noted that the lower limits of the used fuel amount and the lower limits of the work load have been set for every model while taking into consideration the specification of the model.

The server 3 also has a base station-side communication unit 3*g*, which can communicate with external communication units including the machine-side communication unit 11*a*. Using this base station-side communication unit 3*g*, the server 3 can be connected to the hydraulic excavators 20-1 to 20-N, the personal computer (PC) 6 of the company 5 which owns these hydraulic excavators 20-1 to 20-N, and the like via the communication network 7 as mentioned above. The server 3 is a work mode management means, which can instruct, to the main controller 11, the selected one of the different kinds of work modes stored in the work mode storage means 3*f*2 by communications with the control means 10 (main controller 11) while using the base station-side communication unit 3*g*.

The base station 2 also has an input device 4 (mouse, keyboard) as a base station-side work mode instruction means for instructing, to the server 3, which work mode should be selected from the different kinds of work modes stored in the work mode storage means 3*f*2. When a request is made from the company 5 to the base station 2 for the designation of specific one of the work modes as a work mode, a staff of the base station 5 operates the input device 4 to set such that the server 3 will select the designated work mode. The server 3 is set to transmit the selected work mode at predetermined periods from the base station-side communication unit 3*g* to the machine-side communication unit 11*a*.

As a case in which a work mode is designated, there is, for example, a case that only light-load work is planned to be performed on a certain day with respect to several ones of the hydraulic excavators 20-1 to 20-N, and therefore, the eco mode is designated from the company 5 to the base station 2. There is another case that selectable work modes are limited to the normal mode and eco mode, in other words, no heavy-load work is allowed to avoid a reduction in the service lives of the hydraulic excavators.

The target rpm computing means 11*c* of the main controller 11 is set to compute a target rpm based on the work mode instructed by the server 3 (work mode management means) when the work mode is instructed by the server 3 to the main controller 11.

The main controller 11 is set to transmit the information on the work mode, which has been instructed by the instruction switch 13, from the machine-side communication unit 11*a* to the base station-side communication unit 3*g* at predetermined periods.

The server 3 also has a work mode appropriateness determination means 3*a*, which based on the information on the work mode of the main controller 11 as received at the base station-side communication unit 3*g*, determines whether or not the work mode of the main controller 11 is appropriate. This work mode appropriateness determination means 3*a* determines whether or not the work mode of the main controller 11 is a work mode having a higher upper limit in target rpm than the work mode instructed by the input device 4 (base station-side work mode instruction means) and, when the work mode of the main controller 11 is the work mode having the higher upper limit, determines that the work mode of the main controller 11 is in appropriate.

The engine controller 12 of the control means 12 has a used fuel amount computing means 12*b* for computing an amount of fuel used by the engine per unit time. This used fuel amount computing means 12*b* delivers the calculated used fuel amount to the main controller 11. The main controller 11 is set to transmit the information on the used fuel amount, which has been calculated by the used fuel amount computing means 12*b*, from the machine-side communication unit 11*a* to the base station-side communication unit 3*g* at predetermined periods.

The server 3 also has a used fuel amount appropriateness determination means 3*b* for determining whether or not the amount of fuel used by the engine is appropriate. This used fuel amount appropriateness determination means 3*b* determines whether or not the used fuel amount calculated by the used fuel amount computing means 12*b* of the engine controller 12 is smaller than the lower limit of the used fuel amount as set corresponding to the work mode of the main controller 11 out of the lower limits of the used fuel amount as stored in the used fuel amount storage means 3*f*3 and, when the calculated used fuel amount is smaller, determines that the calculated used fuel amount is inappropriate.

When the information on the work mode of the main controller 11 of the hydraulic excavator 20-1 indicates the normal mode, for example, the used fuel amount appropriateness determination means 3*b* reads out, from the used fuel amount storage means 3*f*3, the lower limit of the amount of fuel to be used in the normal mode corresponding to the model of the hydraulic excavator 20-1, and compares the thus-read out lower limit of used fuel amount with the used fuel amount calculated by the used fuel amount computing means 12*b*. When the calculated used fuel amount is found to be smaller than the read-out lower limit of the used fuel amount as a result of the comparison, the calculated used fuel amount can be considered to be less than the amount of fuel to be used in the normal mode, in other words, to fall within the amount range of fuel to be used in the eco mode, said amount range being smaller than the corresponding amount range in the normal mode. Therefore, the calculated used fuel amount is not the amount of fuel to be used in the normal mode, and is determined to be inappropriate.

The main controller 11 is set to transmit, from the machine-side communication unit 11*a* to the base station-side communication unit 3*g* at predetermined periods, the information on the load pressure sensed by the load pressure sensor 60 and the pilot pressure sensed by the pilot pressure sensor 61 or 62, in other words, the information on the operational instruction to the hydraulic excavator 20 by the control lever device 43.

The server 3 also has a work load computing means 3*c* for computing a work load based on the information on the load pressure and the information on the operational instruction from the main controller 11, and a work load appropriateness determination means 3*c* for determining whether or not the work load calculated by the work load computing means 3*c* is appropriate. The work load appropriateness determination means 3*c* determines whether or not the work load calculated by the work load computing means 3*c* is smaller than the lower limit of the work load as set corresponding to the work load of the main controller 11 out of the lower limits of the work load as stored in the work load storage means 3*f*4 and, when the calculated work load is smaller, determines that the calculated work load is inappropriate.

When the information on the work mode of the main controller 11 of the hydraulic excavator 20-1 indicates the normal mode, for example, the work load appropriateness determination means 3*c* reads out, from the used fuel amount storage means 3*f*3, the lower limit of the work load in the normal mode corresponding to the model of the hydraulic excavator 20-1, and compares the thus-read out lower limit of the work load with the work load calculated by the work load computing means 3*c*. When the calculated work load is found to be smaller than the read-out lower limit of the work load as a result of the comparison, the calculated work load falls within the range of work loads in the eco mode. Therefore, the calculated work load is not a work load in the normal mode, and is determined to be inappropriate.

The server 3 is set to instruct the work mode, which has been instructed by the input device 4, to the main controller 11 when the work mode of the main controller 11 is determined to be inappropriate, in other words, the work mode of the main controller 11 is determined to be higher in the upper limit of the target rpm than the work mode instructed by the input device 4 by the work mode appropriateness determination means 3, the amount of fuel used by the engine 50 is determined to be inappropriate, in other words, the amount of fuel used by the engine 50 is small by the used fuel amount appropriateness determination means 3*b*, and the work load is determined to be inappropriate, in other words, the work load is determined to be small by the work load appropriateness determination means 3*c*.

The server 3 also has a search means 3*e* for searching for specific one or ones of the working machines by using the registration information stored in the registration information storage means 3*f*1. The server 3 is set to instruct a work mode to only the working machine or machines searched out by the search means 3*e*. The staff operates the input device 4 to input search conditions to the server 3.

The main controller 11 also has an instructed mode storage means 11*b*2 for storing a work mode instructed from the server 3. This instructed mode storage means 11*b*2 has been arranged by using the auxiliary storage unit 11*b*. It is set that the work mode stored in the instructed mode storage means 11*b*2 of the main controller 11 is successively rewritten to a new work mode whenever the work mode is newly instructed from the server 3. The main controller 11 is set to move to the work mode stored in the instructed mode storage means 11*b*2 at a timing at which the gate lock switch 63 has detected a change in the valve position from the closed position to the open position.

Further, the main controller 11 is connected to a monitor 70 arranged in the operator's cab 22*a*. According to an instruction from the main controller 11, the monitor 70 displays in which one of the three kinds of work modes the main controller 11 has been set. When the main controller 11 has been set in the work mode instructed by the instruction switch 13, the monitor 70 displays, in addition to the work mode, to the effect that the work mode has been set by an instruction from the instruction switch 13. When the main controller 11 has been set in the work mode instructed from the server 3, on the other hand, the monitor 70 displays, in addition to the work mode so set, to the effect that the work mode has been set by an instruction from the server 3.

The remote management system 1 configured as described above operates, for example, as will be described next.

Now assume, for example, that among the hydraulic excavators 20-1 to 20-N, the hydraulic excavators 20-1,20-2 are to be operated.

After the operator of the hydraulic excavator 20-1 has operated a key switch (not shown) to start up the engine 50, the engine 50 is kept on. As a consequence, the main controller 11 and engine controller 12 are started up. Upon this start-up, the main controller 11 is set in the normal mode. The operator of the hydraulic excavator 20-1 performs normal digging work by the hydraulic excavator 20-1 while leaving the setting of the main controller 11 in the normal mode.

Similar to the operator of the hydraulic excavator 20-1, the operator of the hydraulic excavator 20-2 also starts up the engine 50 and also starts up the main controller 11 and engine controller 12. The operator of the hydraulic excavator 20-2 performs light-load work by the hydraulic excavator 20-2 with the setting of the main controller 11 being left in the normal mode.

An instruction to set each of the work modes of the hydraulic excavators 20-1,20-2 in the eco mode is transmitted from the personal computer (PC) 6 of the company 5 to the server 3 of the base station 2 via the communication network 7. Upon receipt of the instruction, the staff of the base station 2 operates the input device 4 to input search conditions so that the search means 3*e* of the server 3 is actuated to search out the information on the hydraulic excavators 20-1,20-2 as stored in the registration information storage means 3*f*1. Further, the server 3 is set such that the eco mode out of the three kinds of work modes stored in the work mode storage means 3*f*2 is selected and the eco mode is instructed to the hydraulic excavators 20-1,20-2.

It is to be noted that the server 3 can be directly operated from the personal computer (PC) 6 of the company 5.

Information on the work mode in which the main controller 11 has been set, information on the load pressure of the main pump 40, information on the operational instruction (pilot pressure) outputted from the control lever device 43 and information on the used fuel amount computed by the used fuel amount computing means 12*b* of the engine controller 12 are transmitted from the machine-side communication units 3*g* of the respective hydraulic excavators 20-1, 20-2 to the base station-side communication unit 3*g*. Based on the information on the work mode of the hydraulic excavator 20-1, the server 3 determines by the work mode appropriateness determination means 3*a* whether or not the work mode is appropriate. Based on the information on the amount of fuel used by the hydraulic excavator 20-1, the server 3 also determines by the used fuel amount appropriateness determination means 3*b* whether or not the used fuel amount is appropriate. Similar to these, the server 3 also determines whether or not the work mode of the hydraulic excavator 20-2 and the amount of fuel used by the hydraulic excavator 20-2 are appropriate.

By the work load computing means 3*c*, the server 3 calculates the work load on the hydraulic excavator 20-1 based on the information on the load pressure on the excavator 20-1 and the information on the operational instruction, and also calculates the work load on the hydraulic excavator 20-2 based on the information on the load pressure on the hydraulic excavator 20-2 and the information on the operational instruction. The server 3 then determines by the work load appropriateness determination means 3*c* whether or not the work loads on the respective hydraulic excavators 20-1,20-2 are appropriate.

Here, the server 3 has been instructed to set both of the hydraulic excavators 20-1,20-2 in the eco mode, but both of the hydraulic excavators 20-1,20-2 have been set in the normal mode. The determination result by the work mode appropriateness determination means 3*a* is, therefore, "inappropriate" with respect to both of the hydraulic excavators 20-1,20-2.

The hydraulic excavator 20-1 is performing normal digging work in the normal mode. The determination results by the used fuel amount appropriateness determination means 3*b* and work load appropriateness determination means 3*c* are both "appropriate".

On the other hand, the hydraulic excavator 20-2 is performing light-load work in the normal mode. The determination results by the used fuel amount appropriateness determination means 3*b* and work load appropriateness determination means 3*c* are both "inappropriate".

With respect to the hydraulic excavator 20-1, the determination result by the work mode appropriateness determination means 3*a* is "inappropriate", but the determination results by the used fuel amount appropriateness determination means 3*b* and work load appropriateness determination means 3*c* are both "appropriate". The server 3, therefore, does not instruct the switching to the eco mode to the main controller 11 of the hydraulic excavator 20-1.

With respect to the hydraulic excavator 20-2, on the other hand, the determination result by the work mode appropriateness determination means 3*a*, used fuel amount appropriateness determination means 3*b* and work load appropriateness determination means 3*c* are all "inappropriate". The server 3, therefore, instructs the switching to the eco mode to the main controller 11 of the hydraulic excavator 20-2 by the base station-side communication unit 3*g*.

Upon receipt of the switching instruction to the eco mode at the machine-side communication unit 11*a* during operation of the hydraulic excavator 20-2, the main controller 11 of the hydraulic excavator 20-2 stores the instruction in the instructed mode storage means 11*b*2. The operator stops the hydraulic excavator 20-2 for a rest, and operates the gate lock lever 48 to switch the valve position of the gate lock valve 47 from the open position to the closed position. As a result of this change in the valve position, the gate lock switch 63 is turned off.

After the end of the rest, the operator operates the gate lock lever 48 of the hydraulic excavator 20-2 to switch the valve position of the gate lock lever 47 from the closed position to the open position. As a result of this change in the valve position, the gate lock switch 63 is turned on. At a timing at which an ON signal has been inputted from the gate lock switch 63, the target rpm computing means 11*c* of the main controller 11 becomes ready to compute a target rpm based on the work mode stored in the instructed mode storage means 11*b*2 during the operation of the hydraulic excavator 20-2 before the rest, that is, the eco mode. As a consequence, the engine rpm of the hydraulic excavator 20-2 becomes lower than that in the normal mode selected by the operator.

According to the remote management system 1 of this embodiment, the following advantageous effects can be obtained.

According to the remote management system 1, a work mode can be instructed by communication from the server 3 of the base station 2 to the main controller 11. The upper limits of the engine rpm of the hydraulic excavators 20-1 to 20-N can, therefore, be set in preference to the setting of the upper limits by the operators. Moreover, they can be set by remote operations from the base station 2, so that the engine rpm can be adequately managed even if there are many hydraulic excavators or the location of the manager is distant from the working machine or machines.

When it is determined by the work mode appropriateness determination means 3*a* in the remote management system 1 that the work mode of the main controller 11 is a work mode having a higher upper limit in target rpm than the work mode instructed by the input device 4 of the base station 2, in other words, the work mode of the main controller 11 is inappropriate, the server 3 instructs to the main controller 11 the work mode instructed by the input device 4. As a consequence, the upper limit of the engine rpm can be lowered, and therefore, the amount of fuel to be used per unit time can be decreased.

When it is determined by the used fuel amount appropriateness determination means 3*b* in the remote management system 1 that the used fuel amount calculated by the used fuel amount computing means 12*b* is smaller than the lower limit of the used fuel amount as set corresponding to the work mode of the main controller 11 out of the lower limits of the used fuel amount as stored in the used fuel amount storage means 3*f*3, in other words, the calculated used fuel amount is inappropriate, the server 3 instructs to the main controller 11 the work mode instructed by the input device 4. As a consequence, the amount of fuel to be used per unit time can be surely decreased.

When it is determined by the work load appropriateness determination means 3*c* in the remote management system 1 that the work load calculated by the work load computing means 3*c* is smaller than the lower limit of the work load as set corresponding to the work load of the main controller 11 out of the lower limits of the work load as stored in the work load storage means 3*f*4, in other words, the calculated work load is in appropriate, and further, the work mode of the main controller 11 has a higher upper limit in target rpm than the work mode instructed by the input device 4 of the base station 2, the work mode instructed by the input device 4 is instructed to the main controller 11. As a consequence, it is possible to avoid instructing such a work mode as lowering the upper limit of the target rpm if an excessively large work load is expected to be applied to the hydraulic excavator in the work mode which is about to be instructed from the base station 2 to the main controller 11. It is, therefore, possible to avoid the occurrence of a situation that the work efficiency of the hydraulic excavator would be lowered as a result of a reduction in the upper limit of the target rpm.

In the remote management system 1, the server 3 instructs a work mode to only specific hydraulic excavator or excavators searched out by the search means 3*e*. As a consequence, it is possible to individually determine with respect to the plural hydraulic excavators 20-1 to 20-N whether or not the upper limit of the target rpm should be lowered.

The search by the search means 3*e* can be performed under the conditions set by the instruction switch 13, such as the work mode, used furl amount and load pressure.

In the remote management system 1, the control means 10 (main controller 11) moves to the work mode stored in the work mode storage means 11*b* at a timing at which the gate lock switch 63 (gate lock detection means) has detected a change in the valve position from the closed position to the open position. The timing at which the gate lock switch 63 has detected the change in the valve position from the closed position to the open position is shortly after that the feeding of a pilot pressure to the control valve 41 has become feasible. At this time, the valve position of the control valve 41 is not a valve position at which oil delivered from the main pump can be guided to the corresponding hydraulic actuator, and therefore, the working machine is at rest. During a rest of the working machine, the control means 10, therefore, moves to the work mode stored in the instructed mode storage means 11*b*2. As a consequence, it is possible to prevent the engine rpm from suddenly dropping during work by the hydraulic excavator. The upper limit of the engine rpm can, therefore, be lowered safely.

In the remote management system according to above-described embodiment, a work mode is instructed from the work mode management means (server 3) to the control means (main controller 11) when the work mode, used fuel amount and work load have all been determined to be inappropriate. However, the present invention is not limited to such an embodiment, and the remote management system may be modified to instruct a work mode from the work mode management means to the control means when any one or two of the work mode, used fuel amount and work load have been determined to be inappropriate.

The remote management system according to above-described embodiment has the instructed mode storage means 11*b*2, which stores the work mode instructed from the server 3 when the gate lock switch 63 has detected a change in the valve position from the open position to the closed position, and the control means 10 is set to move to the work mode stored in the instructed mode storage means 11*b*2 at the timing at which the gate lock switch 63 has detected a change in the valve position from the closed position to the open position. However, the instructed mode storage means and target rpm computing means in the present invention shall not be limited to them. The instructed mode storage means 11*b*2 may be set to store the work mode instructed from the server 3 upon shut-down of the control means 10 (main controller 11) and to move to the work mode stored in the instructed mode storage means 11*b*2 at the timing of a start-up of the control means 10.

As the time of a start-up of the main controller 11 is before a start-up of the engine 50 or shortly after the start-up of the engine 50, the hydraulic excavator is at rest. The control means 10, therefore, moves to the work mode stored in the instructed mode storage means 11*b*2 during a rest of the hydraulic excavator. As a consequence, it is possible, like the above-described embodiment, to prevent the engine rpm from suddenly dropping during work by the hydraulic excavator. The upper limit of the engine rpm can, therefore, be lowered safely.

LEGEND

1 Remote management system
1 Base station

2 Server (work mode management means)
3*a* Work mode appropriateness determination means
3*b* Used fuel amount appropriateness determination means
3*c* Work load computing means
3*d* Work load appropriateness determination means
3*e* Search means
3*f* Auxiliary storage unit
3*f*1 Registration information storage means
3*f*2 Work mode storage means
3*f*3 Used fuel amount storage means
3*f*4 Work load storage means
3*g* base station-side communication unit
4 Input device (base station-side work mode instruction means
10 Control means
11 Main controller
11*a* Machine-side communication unit
11*b* Auxiliary storage unit
11*d*1 Target rpm storage means
11*b*2 Instructed mode storage means
11*c* Target rpm computing means
12 Engine controller
12*b* Used fuel amount computing means
13 Instruction switch (machine-side work mode instruction means)
14 EC dial selector
40 Main pump (hydraulic pump)
50 Engine
47 Gate lock valve
60 Load pressure sensor (load pressure sensing means)
61,62 Pilot pressure sensors (operational instruction detection means)
63 Gate lock switch (gate lock detection means)

The invention claimed is:

1. A remote management system, said remote management system comprising:

a working machine; and a base station, wherein the working machine comprises an engine as a drive source for a hydraulic pump that delivers pressure oil to be fed to plural hydraulic actuators, an engine rpm control device configured to control an rpm of the engine, and a machine-side work mode instruction device configured to selectively instruct plural kinds of work modes to the engine rpm control device, the engine rpm control device comprises a target rpm storage device in which upper limits of a target rpm for the engine as set corresponding to respective ones of the plural kinds of work modes have been stored, a target rpm computing device configured to select one of the upper limits of the target rpm, which have been stored in the target rpm storage device, according to the work mode instructed by the machine-side work mode instruction device and computing a target rpm not greater than the selected upper limit, and a machine-side communication unit, the base station comprises a work mode storage device in which the work modes of the working machine have been stored beforehand, a base station-side work mode instruction device configured to select a desired one of the work modes stored in the work mode storage device, a base station-side communication unit capable of communicating with the machine-side communication unit, and a work mode management device capable of instructing the work mode, which has been selected by the base station-side work mode instruction device, to the engine rpm control device via the base station-side communication unit, the target rpm computing device of the working machine is set such that, when the work mode is instructed to the engine rpm control device by the work mode management device of the base station, a target rpm is computed based on the work mode instructed by the work mode management device, the engine rpm control device is set such that information on the work mode instructed by the machine-side work mode instruction device is transmitted by the machine-side communication unit to the base station-side communication unit, the base station further comprises a work mode appropriateness determination device for determining, based on the information on the work mode of the engine rpm control device as received by the base station-side communication unit, whether or not the work mode instructed to the engine rpm control device is appropriate, the work mode appropriateness determination device determines whether or not the work mode of the engine rpm control device is a work mode having a higher upper limit in target rpm than the work mode instructed by the base station-side work mode instruction device and, when the work mode of the engine rpm control device is the work mode having the higher upper limit, determines that the work mode instructed to the engine rpm control device by the machine-side work mode instruction device is inappropriate, and the work mode management device is set such that, when the work mode of the engine rpm control device is determined to be inappropriate by the work mode appropriateness determination device, the work mode instructed by the base station-side work mode instruction device is instructed to the engine rpm control device, and the engine rpm control device further comprises a used fuel amount computing device configured to compute an amount of fuel used by the engine per unit time, and is set such that the information on the work mode instructed by the machine-side work mode instruction device and the information on the used amount of fuel as calculated by the used fuel amount computing device are transmitted by the machine-side communication unit to the base station-side communication unit, the base station further comprises a used fuel amount storage device in which lower limits of an amount of fuel to be used per unit time as set beforehand corresponding to respective ones of the plural kinds of work modes have been stored and a used fuel amount appropriateness determination device configured to determine whether or not the amount of the fuel used by the engine is appropriate, the used fuel amount appropriateness determination device determines whether or not the used amount of fuel as calculated by the used fuel amount computing device of the engine rpm control device is smaller than the lower limit of used fuel amount corresponding to the work mode of the engine rpm control device as stored in the used fuel amount storage device and, when the thus-calculated used fuel amount is smaller, determines the thus-calculated used fuel amount to be inappropriate, and the work mode management device is set such that, when the amount of fuel used by the engine is determined to be inappropriate by the used fuel amount appropriateness determination device and the work mode of the engine rpm control device is determined to be inappropriate by the work mode appropriateness determination device, the work mode instructed by the base station-side work mode instruction device is instructed to the engine rpm control device.

2. The remote management system according to claim 1, wherein:

the base station further comprises a registration information storage device in which registration information on plural working machines have been stored beforehand, and a search device configured to search for a specific one of the working machines by using the registration information stored in the registration information storage device, and the work mode management device is set such that the work mode is instructed to only the working machine searched out by the search device.

3. A remote management system, said remote management system comprising:

a working machine; and a base station, wherein the working machine comprises an engine as a drive source for a hydraulic pump that delivers pressure oil to be fed to plural hydraulic actuators, an engine rpm control device configured to control an rpm of the engine, and a machine-side work mode instruction device configured to selectively instruct plural kinds of work modes to the engine rpm control device, the engine rpm control device comprises a target rpm storage device in which upper limits of a target rpm for the engine as set corresponding to respective ones of the plural kinds of work modes have been stored, a target rpm computing device configured to select one of the upper limits of the target rpm, which have been stored in the target rpm storage device, according to the work mode instructed by the machine-side work mode instruction device and computing a target rpm not greater than the selected upper limit, and a machine-side communication unit, the base station comprises a work mode storage device in which the work modes of the working machine have been stored beforehand, a base station-side work mode instruction device configured to select a desired one of the work modes stored in the work mode storage device, a base station-side communication unit capable of communicating with the machine-side communication unit, and a work mode management device capable of instructing the work mode, which has been selected by the base station-side work mode instruction device, to the engine rpm control device via the base station-side communication unit, the target rpm computing device of the working machine is set such that, when the work mode is instructed to the engine rpm control device by the work mode management device of the base station, a target rpm is computed based on the work mode instructed by the work mode management device, the engine rpm control device is set such that information on the work mode instructed by the machine-side work mode instruction device is transmitted by the machine-side communication unit to the base station-side communication unit, the base station further comprises a work mode appropriateness determination device for determining, based on the information on the work mode of the engine rpm control device as received by the base station-side communication unit, whether or not the work mode instructed to the engine rpm control device is appropriate, the work mode appropriateness determination device determines whether or not the work mode of the engine rpm control device is a work mode having a higher upper limit in target rpm than the work mode instructed by the base station-side work mode instruction device and, when the work mode of the engine rpm control device is the work mode having the higher upper limit, determines that the work mode instructed to the engine rpm control device by the machine-side work mode instruction device is inappropriate, and the work mode management device is set such that, when the work mode of the engine rpm control device is determined to be inappropriate by the work mode appropriateness determination device, the work mode instructed by the base station-side work mode instruction device is instructed to the engine rpm control device, and the working machine further comprises a load pressure detection device configured to detect a load pressure on the hydraulic pump and plural operational instruction detection device configured to detect operational instructions to respective ones of the plural hydraulic actuators, the target rpm computing device is set such that, based on the load pressure detected by the load pressure detection device and the operational instructions detected by the plural operational instruction detection device, a target rpm not greater than the upper limit of the target rpm as set corresponding to the work mode is calculated, the engine rpm control device is set such that the information on the work mode instructed by the machine-side work mode instruction device, the information on the load pressure and the information on the operational instructions are transmitted by the machine-side communication unit to the base station-side communication unit, the base station further comprises a work load storage device in which lower limits of a work load as set beforehand corresponding to respective ones of the plural kinds of work modes have been stored, a work load computing device configured to compute a work load based on the information on the work load and the operational instruction from the engine rpm control device, and a work load appropriateness determination device configured to determine whether or not the work load calculated by the work load computing device is appropriate, and the work load appropriateness determination-device determines whether or not the work load calculated by the work load computing device is smaller than the lower limit of work load as stored in the work load storage device and corresponding to the work mode of the engine rpm control device and, when the calculated work load is smaller, determines the calculated work load to be inappropriate, and the work mode management device is set such that, when the work load is determined to be inappropriate by the work load appropriateness determination device and the work mode of the engine rpm control device is determined to be inappropriate by the work load appropriateness determination device, the work mode instructed by the base station-side work mode instruction device is instructed to the engine rpm control device.

4. The remote management system according to claim 3, wherein:

the base station further comprises a registration information storage device in which registration information on plural working machines have been stored beforehand, and a search device configured to search for a specific one of the working machines by using the registration information stored in the registration information storage device, and the work mode management device is set such that the work mode is instructed to only the working machine searched out by the search device.

5. A remote management system, said remote management system comprising:

a working machine; and a base station, wherein the working machine comprises an engine as a drive source for a hydraulic pump that delivers pressure oil to be fed to plural hydraulic actuators, an engine rpm control device configured to control an rpm of the engine, and a machine-side work mode instruction device configured to selectively instruct plural kinds of work modes to the engine rpm control device, the engine rpm control device comprises a target rpm storage device in which upper limits of a target rpm for the engine as set corresponding to respective ones of the plural kinds of work modes have been stored, a target rpm computing device configured to select one of the upper limits of the target rpm, which have been stored in the target rpm storage device, according to the work mode instructed by the machine-side work mode instruction device and computing a target rpm not greater than the selected upper limit, and a machine-side communication unit, the base station comprises a work mode storage device in which the work modes of the working machine have been stored beforehand, a base station-side work mode instruction device configured to select a desired one of the work modes stored in the work mode storage device, a base station-side communication unit capable of communicating with the machine-side communication unit, and a work mode management device capable of instructing the work mode, which has been selected by the base station-side work mode instruction device, to the engine rpm control device via the base station-side communication unit, the target rpm computing device of the working machine is set such that, when the work mode is instructed to the engine rpm control device by the work mode management device of the base station, a target rpm is computed based on the work mode instructed by the work mode management device, the engine rpm control device is set such that information on the work mode instructed by the machine-side work mode instruction device is transmitted by the machine-side communication unit to the base station-side communication unit, the base station further comprises a work mode appropriateness determination device for determining, based on the information on the work mode of the engine rpm control device as received by the base station-side communication unit, whether or not the work mode instructed to the engine rpm control device is appropriate, the work mode appropriateness determination device determines whether or not the work mode of the engine rpm control device is a work mode having a higher upper limit in target rpm than the work mode instructed by the base station-side work mode instruction device and, when the work mode of the engine rpm control device is the work mode having the higher upper limit, determines that the work mode instructed to the engine rpm control device by the machine-side work mode instruction device is inappropriate, and the work mode management device is set such that, when the work mode of the engine rpm control device is determined to be inappropriate by the work mode appropriateness determination device, the work mode instructed by the base station-side work mode instruction device is instructed to the engine rpm control device, and the working machine further comprises a load pressure detection device configured to detect a load pressure on the hydraulic pump and plural operational instruction detection device configured to detect operational instructions to respective ones of the plural hydraulic actuators, the target rpm computing device is set such that, based on the load pressure detected by the load pressure detection device and the operational instructions detected by the plural operational instruction detection device, a target rpm not greater than the upper limit of the target rpm as set corresponding to the work mode is calculated, the engine rpm control device comprises a used fuel amount computing device configured to compute an amount of fuel used by the engine per unit time, the engine rpm control device is set such that the information on the work mode instructed by the machine-side work mode instruction device, the information on the load pressure, the information on the operational instructions and the information on the used amount of fuel as calculated by the used fuel amount computing device are transmitted by the machine-side communication unit to the base station-side communication unit, the base station further comprises a used fuel amount storage device in which lower limits of an amount of fuel used per unit time as set beforehand corresponding to respective ones of the plural kinds of work modes have been stored, a used fuel amount appropriateness determination device configured to determine whether or not the amount of fuel used by the engine is appropriate, a work load storage device in which lower limits of a work load as set beforehand corresponding to respective ones of the plural kinds of work modes have been stored beforehand, a work load computing device configured to compute a work load based on the information on the work load and the operational instructions from the engine rpm control device, and a work load appropriateness determination device configured to determine whether or not the work load calculated by the work load computing device is appropriate, the used fuel amount appropriateness determination device determines whether or not the used amount of fuel as calculated by the used fuel amount computing device of the engine rpm control device is smaller than the lower limit of the used fuel amount as stored in the used fuel amount storage device and corresponding to the work mode of the engine rpm control device and, when the calculated used fuel amount is smaller, determines the calculated used fuel amount to be inappropriate, the work load appropriateness determination device determines whether or not the work load calculated by the work load computing device is smaller than the lower limit of work load as stored in the work load storage device and corresponding to the work mode of the engine rpm control device and, when the calculated work load is smaller, determines the calculated work load to be inappropriate, and the work mode management device is set such that, when the amount of fuel used by the engine is determined to be inappropriate by the used fuel amount appropriateness determination device, the work load is determined to be inappropriate by the work load appropriateness determination device and the work mode of the engine rpm control device is determined to be inappropriate by the work load appropriateness determination device, the work mode instructed by the base station-side work mode instruction device is instructed to the engine rpm control device.

6. The remote management system according to claim 5, wherein:

the base station further comprises a registration information storage device in which registration information on plural working machines have been stored beforehand, and a search device configured to search for a specific one of the working machines by using the registration information stored in the registration information storage device, and the work mode management device is set such that the work mode is instructed to only the working machine searched out by the search device.

7. A remote management system, said remote management system comprising:

a working machine; and a base station, wherein the working machine comprises an engine as a drive source for a hydraulic pump that delivers pressure oil to be fed to plural hydraulic actuators, an engine rpm control device configured to control an rpm of the engine, and a machine-side work mode instruction device configured to selectively instruct plural kinds of work modes to the engine rpm control device, the engine rpm control device comprises a target rpm storage device in which upper limits of a target rpm for the engine as set corresponding to respective ones of the plural kinds of work modes have been stored, a target rpm computing device configured to select one of the upper limits of the target rpm, which have been stored in the target rpm storage device, according to the work mode instructed by the machine-side work mode instruction device and computing a target rpm not greater than the selected upper limit, and a machine-side communication unit, the base station comprises a work mode storage device in which the work modes of the working machine have been stored beforehand, a base station-side work mode instruction device configured to select a desired one of the work modes stored in the work mode storage device, a base station-side communication unit capable of communicating with the machine-side communication unit, and a work mode management device capable of instructing the work mode, which has been selected by the base station-side work mode instruction device, to the engine rpm control device via the base station-side communication unit, the target rpm computing device of the working machine is set such that, when the work mode is instructed to the engine rpm control device by the work mode management device of the base station, a target rpm is computed based on the work mode instructed by the work mode management device, a timing at which the engine rpm control device moves to the work mode instructed by the work mode management device of the base station is set to fall during a rest of the working machine, and the engine rpm control device further comprises an instructed mode storage device configured to store the work mode, which has been instructed from the work mode management device of the base station, upon shut-down of the engine rpm control device, and is set such that at a timing of a start-up of the engine rpm control device, the engine rpm control device moves to the work mode stored in the instructed mode storage device.

8. The remote management system according to claim 7, wherein:

the base station further comprises a registration information storage device in which registration information on plural working machines have been stored beforehand, and a search device configured to search for a specific one of the working machines by using the registration information stored in the registration information storage device, and the work mode management device is set such that the work mode is instructed to only the working machine searched out by the search device.

9. A remote management system, said remote management system comprising:

a working machine; and a base station, wherein the working machine comprises an engine as a drive source for a hydraulic pump that delivers pressure oil to be fed to plural hydraulic actuators, an engine rpm control device configured to control an rpm of the engine, and a machine-side work mode instruction device configured to selectively instruct plural kinds of work modes to the engine rpm control device, the engine rpm control device comprises a target rpm storage device in which upper limits of a target rpm for the engine as set corresponding to respective ones of the plural kinds of work modes have been stored, a target rpm computing device configured to select one of the upper limits of the target rpm, which have been stored in the target rpm storage device, according to the work mode instructed by the machine-side work mode instruction device and computing a target rpm not greater than the selected upper limit, and a machine-side communication unit, the base station comprises a work mode storage device in which the work modes of the working machine have been stored beforehand, a base station-side work mode instruction device configured to select a desired one of the work modes stored in the work mode storage device, a base station-side communication unit capable of communicating with the machine-side communication unit, and a work mode management device capable of instructing the work mode, which has been selected by the base station-side work mode instruction device, to the engine rpm control device via the base station-side communication unit, the target rpm computing device of the working machine is set such that, when the work mode is instructed to the engine rpm control device by the work mode management device of the base station, a target rpm is computed based on the work mode instructed by the work mode management device, a timing at which the engine rpm control device moves to the work mode instructed by the work mode management device of the base station is set to fall during a rest of the working machine, the working machine further comprises hydraulic pilot control valves arranged corresponding to respective ones of the plural hydraulic actuators to control directions and flow rates of flows of pressure oil to be fed to the corresponding hydraulic actuators, a gate lock valve capable of cutting off feeding of a pilot pressure to the hydraulic pilot control valves, and a gate lock detection device configured to detect whether a valve position of the gate lock valve is a closed position where the pilot pressure is cut off or an open position where the pilot pressure is communicated, and the engine rpm control device further comprises an instructed mode storage device configured to store the work mode instructed from the work mode management device when the gate lock detection device has detected a change in the valve position from the open position to the closed position, and is set such that, at a timing at which the gate lock detection device has detected a change in the valve position from the closed position to the open position, the engine rpm control device moves to the work mode stored in the instructed mode storage device.

10. The remote management system according to claim 9, wherein:

the base station further comprises a registration information storage device in which registration information on plural working machines have been stored beforehand, and a search device configured to search for a specific one of the working machines by using the registration information stored in the registration information storage device, and the work mode management device is set such that the work mode is instructed to only the working machine searched out by the search device.

* * * * *